US006514108B2

(12) United States Patent
von Bergen

(10) Patent No.: US 6,514,108 B2
(45) Date of Patent: Feb. 4, 2003

(54) OCEAN-GOING SHIP, AND AN OCEAN-GOING VESSEL WITH A STERN TUBE SEAL ARRANGEMENT FOR SEALING A STERN TUBE FOR A PROPELLER DRIVE SHAFT, AND AN ARRANGEMENT FOR SEALING PROPELLER DRIVE SHAFTS IN AN OCEAN-GOING VESSEL

(75) Inventor: Ernst-Peter von Bergen, Ahlefeld (DE)

(73) Assignee: B+V Industrietechnik GmbH, Hamburg (DE)

( * ) Notice: Subject to any disclaimer, the term of this patent is extended or adjusted under 35 U.S.C. 154(b) by 0 days.

(21) Appl. No.: 10/035,010

(22) Filed: Dec. 27, 2001

(65) Prior Publication Data

US 2002/0111092 A1 Aug. 15, 2002

(30) Foreign Application Priority Data

Dec. 28, 2000 (DE) ..... 100 65 587

(51) Int. Cl.[7] ..... B63H 23/34
(52) U.S. Cl. ..... 440/83; 440/112
(58) Field of Search ..... 440/83, 112; 277/300, 277/345

(56) References Cited

U.S. PATENT DOCUMENTS 4,575,315 A * 3/1986 Galais et al. ..... 310/87
4,990,057 A * 2/1991 Rollins ..... 184/108
5,643,026 A * 7/1997 Pietsch et al. ..... 277/320
5,683,278 A 11/1997 Pietsch et al.
5,795,199 A 8/1998 Langenberg et al.

* cited by examiner

*Primary Examiner*—Stephen Avila
(74) *Attorney, Agent, or Firm*—Nils H. Ljungman & Associates

(57) ABSTRACT

There is now provide an ocean-going ship, and an ocean-going vessel with a stern tube seal arrangement for sealing a stern tube for a propeller drive shaft, and an arrangement for sealing propeller drive shafts in an ocean-going vessel. In the seal arrangement there is provided a compensation to balance pressure fluctuations that arise in the lubricating oil chamber due to axial oscillations of the shaft. In this, the change of pressure is determined by a sensor and this actual value is passed to a comparator element. The comparator element controls a pressure valve so as to control the extent of filling of an annular tubular expandable body, whereby the expandable body impacts on the lubricating oil chamber. By way of a phase shift of 180 degrees in reference to the sensed pressure impulse in the event of an increase in volume of the expandable body, a minimized pressure fluctuation in the lubricating oil chamber can be controlled.

20 Claims, 6 Drawing Sheets

OCEAN-GOING SHIP, AND AN OCEAN-GOING VESSEL WITH A STERN TUBE SEAL ARRANGEMENT FOR SEALING A STERN TUBE FOR A PROPELLER DRIVE SHAFT, AND AN ARRANGEMENT FOR SEALING PROPELLER DRIVE SHAFTS IN AN OCEAN-GOING VESSEL

BACKGROUND OF THE INVENTION

1. Field of the Invention:

The invention relates to an ocean-going ship, and an ocean-going vessel with a stern tube seal arrangement for sealing a stern tube for a propeller drive shaft, and an arrangement for sealing propeller drive shafts in an ocean-going vessel.

2. Background Information

Seal arrangements for ships of this type are known in a multiplicity of embodiments. In actual use it has been shown that during operation by way of axial oscillations of the shaft the associated bushing is moved to and fro. Thus, oscillations of approximately 11 Hertz arise in the case of larger vessels. This causes overpressures and negative pressures in the lubricating oil chamber in relative short time periods, because a pressure equalization by way of the stern tube bearing and the conduits up to the upper tank is substantially not possible.

The overpressure or the negative pressure, respectively, in the lubricating oil chamber affects the seal rings to a large extent. In connection with this there often arises a large loss of oil into the stern tube. The large strain placed on the seals gives frequently rise to operational problems.

OBJECT OF THE INVENTION

It is the object of the present invention, in at least one embodiment, to improve the seal arrangement embodiment of the type described and to minimize in a simple manner oil pressure fluctuations and to avoid functional problems arising because of oil pressure fluctuations.

SUMMARY OF THE INVENTION

The invention teaches that this object can be accomplished by an ocean-going ship, said ship comprising: a propeller; a shaft mounted for rotation of said propeller; bearing means to journal said shaft; a bushing mounted on said shaft; said bushing having a first end immersed in water when said ship is afloat on water, and a second end opposite said first end near said bearing means; a plurality of seals mounted on said bushing; said plurality of seals comprising lip seals; a plurality of annular elements to maintain said plurality of seals in spaced apart relationship on said bushing; said plurality of annular elements being configured and disposed to provide a plurality of first annular chambers for lubricant to lubricate at least said bearing means; said bushing comprising an annular surface at said second end thereof; said annular surface at said second end of said bushing being configured and disposed to form a portion of a second annular chamber for lubricant to lubricate said bearing means; said plurality of seals being configured and disposed to minimize ingress of water and to retain lubricant for said bearing means in said second annular chamber; at least one seal of said plurality of seals being configured and disposed adjacent to said bearing means; a sensor; said sensor being configured and disposed to sense at least one parameter representative of pressure variations of a lubricant in said second annular chamber due to axial oscillations of said shaft; said sensor being further configured to produce a signal representative of pressure variations of a lubricant in said second annular chamber due to axial oscillations of said shaft; a comparator element; said comparator element being configured and disposed to receive signals representative of pressure variations of a lubricant in said second annular chamber due to axial oscillations of said shaft; said comparator element further being configured to compare signals representative of pressure variations of a lubricant in said second annular chamber due to axial oscillations of said shaft with desired pressure conditions; a control element; said control element being configured and disposed to receive signals from said comparator element to effectuate compensation for pressure variations of a lubricant in said second annular chamber due to axial oscillations of said propeller shaft; an expandable and contractable element; said expandable and contractable element being configured to be filled with a pressure medium and to exert pressure on a lubricant in said second annular chamber to compensate for pressure variations of a lubricant in said second annular chamber due to axial oscillations of said propeller shaft; said comparator being further configured to pass signals, to said control element, to effectuate compensation for pressure variations of a lubricant in said second annular chamber due to axial oscillations of said propeller shaft; and said control element being configured to control the extent of filling of said expandable and contractable element to thus adjust pressure conditions exerted upon a lubricant in said second annular chamber with a phase shift of approximately 180 degrees for an actual lubrication pressure condition in said second annular chamber; thus forming an arrangement to compensate and to minimize lubrication pressure fluctuations, of a ship's stern tube seal arrangement, due to Coaxial oscillations of said propeller shaft.

The invention also teaches that the foregoing object can be accomplished in a ship by an arrangement to compensate lubrication pressure fluctuations in a ship's stern tube seal arrangement due to axial oscillations of a ship's propeller shaft, said arrangement comprising: a shaft mounted for rotation of a ship's propeller; bearing means to journal said shaft; a bushing mounted on said shaft; said bushing having a first end immersed in water when the ship is afloat on water, and a second end opposite said first end and adjacent to said bearing means; a seal arrangement configured and disposed to minimize ingress of water and to retain lubricant for said bearing means; a lubricating arrangement configured and disposed to provide lubricant to said seal arrangement and to said bearing means; a sensor; said sensor being configured and disposed to sense at least one parameter representative of pressure variations in said seal arrangement due to axial oscillations of said propeller shaft; said sensor further being configured to generate signals representative of pressure variations in said seal arrangement; a comparator element; said comparator element being configured and disposed to receive signals, representative of pressure variations in said seal arrangement, from said sensor; said comparator element further being configured to compare signals representative of pressure variations in said seal arrangement with desired pressure conditions; a control element configured and disposed to receive signals from said comparator element to effectuate compensation for pressure variations in said seal arrangement due to axial oscillations of said propeller shaft; and an expandable and contractable element; said expandable and contractable element being configured to be filled with a pressure medium and to exert pressure on a lubricant in said lubricating arrangement to compensate for pressure variations in said seal arrangement due to axial oscillations of said propeller shaft; said comparator being further configured to pass signals, to said control element, to effectuate compensation for pressure variations in said seal arrangement due to axial oscillations of said propeller shaft; and said control element being configured to control the extent of filling of said expandable and contractable element to thus adjust pressure conditions exerted in said lubricating arrangement with a phase shift of approximately 180 degrees for the sensed lubrication pressure in said lubricating arrangement; thus forming an arrangement to compensate and to minimize lubrication pressure fluctuations, of a ship's stern tube seal arrangement, due to axial oscillations of said propeller shaft.

The invention further teaches that the foregoing object can be accomplished by an arrangement to compensate lubrication pressure oscillations in a ship's stern tube seal arrangement due to axial oscillations of a ship's propeller shaft, said compensating arrangement comprising: a sensor configured to be disposed to sense at least one parameter representative of pressure oscillations, in a ships's stern tube seal arrangement, due to axial oscillations of a ship's propeller shaft; and an arrangement configured to be disposed to compensate for oscillations of lubrication pressure due to axial oscillations of a ship's propeller shaft to compensate for and to minimize stern tube seal lubrication pressure oscillations of a ship's stern tube seal arrangement due to axial oscillations of a ship's propeller shaft; said compensation arrangement being configured to receive a signal from said sensor, to thus form an arrangement to compensate for and to minimize lubrication pressure oscillations in a ship's stern tube seal arrangement due to axial oscillations of a ship's propeller shaft.

The invention teaches, in one embodiment, that pressure fluctuations that arise in the lubricating oil chamber are passed in the form of axial oscillations of the shaft via an annular piston surface of the bushing, by way of a sensor, for the determination of pressure changes—as actual—value to a comparator element, which comparator element actuates a control element, such as, a pressure valve, in order to control the extent of filling of an annular tubular expandable body, whereby the expandable body impacts on the lubricating oil chamber and impacts the volume of the lubricating oil chamber with a phase shift of approximately 180 degrees in reference to the sensed pressure impulse, so as to attain a minimized pressure fluctuation in the lubricating oil chamber.

Thus, there is carried out a countervailing control, by way of the expandable body, for compensation of oil pressure fluctuations configured by sinusoidal oscillation. The expandable body always then attains a maximum or minimum when the oil pressure in the lubricating oil chamber has attained a minimum or a maximum. The oil that is displaced from the surface of the annular piston is accordingly absorbed by the condition of the expandable body.

An advantageous embodiment resides therein that the sensor is disposed in the lubricating oil chamber and/or the axial oscillation of the shaft can be passed by way of a measuring flange with associated measuring sensor, for the formulation of an actual value, to the compensating element.

It is also advantageous that the expandable body is disposed in an annular chamber ahead of a seal which is disposed alongside the shaft bearing and ahead of the lubricating oil chamber and the expandable body is connected to the lubricating oil chamber by way of an oil channel.

It is also provided that the expandable body is configured to be impacted on one side and acts horizontally or vertically upon the lubricating oil chamber.

As an alternative an expandable body is configured with a receiving space for retention of lubricating oil and with its closed, facing-away side can be impacted on three sides in a controllable chamber as controllable pressure chamber.

For the purpose of further improvement and optimization it is suggested that the comparator element is configured as controller which is supplied with a guide value, and the controller and control element are part of a control circuit.

The above-discussed embodiments of the present invention will be described further herein below with reference to the accompanying figures. When the word "invention" is used in this specification, the word "invention" includes "inventions", that is, the plural of "invention". By stating "invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

The invention is explained in greater detail below with reference to the embodiments which are illustrated in the accompanying drawings.

DESCRIPTION OF THE PREFERRED EMBODIMENT

Figure 1:
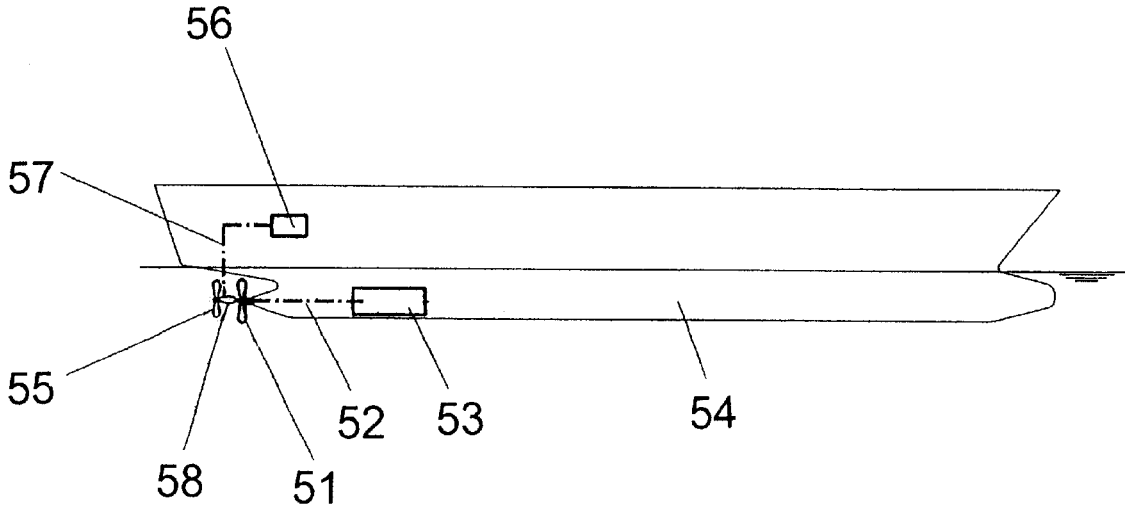
FIG. 1 schematically shows a vessel equipped with a propeller system in a side view.

In accordance with one embodiment, FIG. 1 shows a vessel with hull 54. The vessel has a forward propeller 51 which is driven by means of the drive shaft 52 and the drive system 53. The aft propeller 55 is driven by means of an additional drive system 56, and is realized so that it can pivot around the vertical axis 57. Shown is a realization of the present invention including a rudder plate 58 on which the rear propeller 55 is located.

FIG. 1 is a copy of FIG. 1 from U.S. Pat. No. 5,795,199 issued to Langenberg, et al. on Aug. 18, 1998 and entitled "Propeller Drive for Watercraft", in which copy all of the reference numerals present in the original figure, as it appears in U.S. Pat. No. 5,795,199 have been changed to suit the present disclosure. U.S. Pat. No. 5,795,199 is hereby incorporated by reference as if set forth in its entirety. The reference numerals that have been changed in FIG. 1 of U.S. Pat. No. 5,795,199, essentially reproduced herein as FIG. 1, indicate arrangements that are well known in the prior art.

Figure 2:
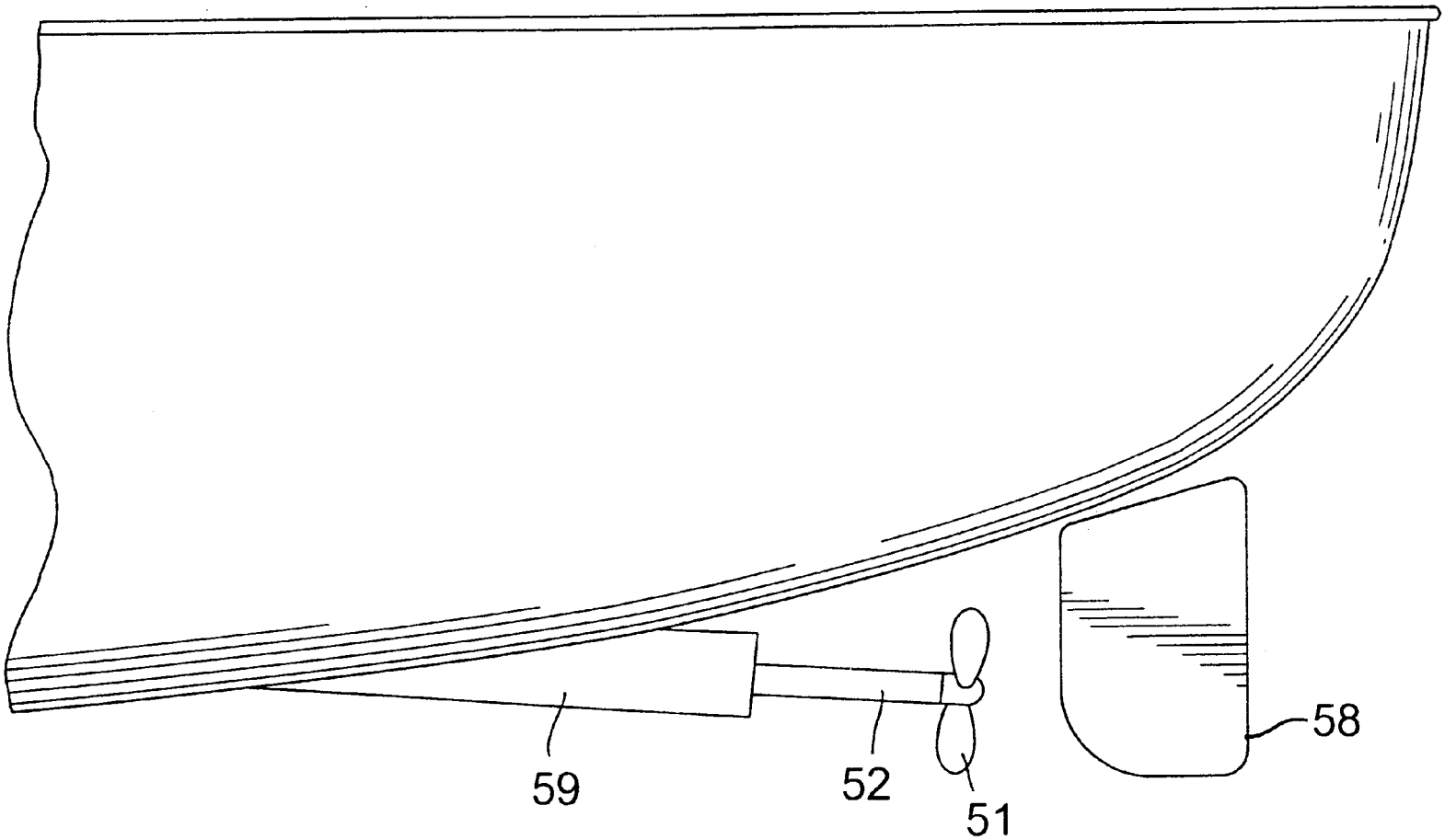
FIG. 2 is a detail of the stern of a ship.

FIG. 2 generally shows the bottom rear portion of a hull of a typical deep-draft or seagoing vessel with a single propeller 51. A propeller shaft 52 passes from the interior of the ship to the exterior thereof through a stern tube 59. The propeller 51 can preferably be affixed to the end of the shaft 52.

FIG. 2 is a copy of FIG. 1A from U.S. Pat. No. 5,683,278 issued to Pietsch, et al. on Nov. 4, 1997 and entitled "Stern Tube Seal With a Pressure Control System to Adjust to the Changing Draft of Ocean-going Ships", in which copy all of the reference numerals present in the original figure, as it appears in U.S. Pat. No. 5,683,278 have been changed to suit the present disclosure. U.S. Pat. No. 5,683,278 is hereby incorporated by reference as if set forth in its entirety. The reference numerals that have been changed in FIG. 1 of U.S. Pat. No. 5,683,278, essentially reproduced herein as FIG. 2, indicate arrangements that are well known in the prior art.

Figure 3:
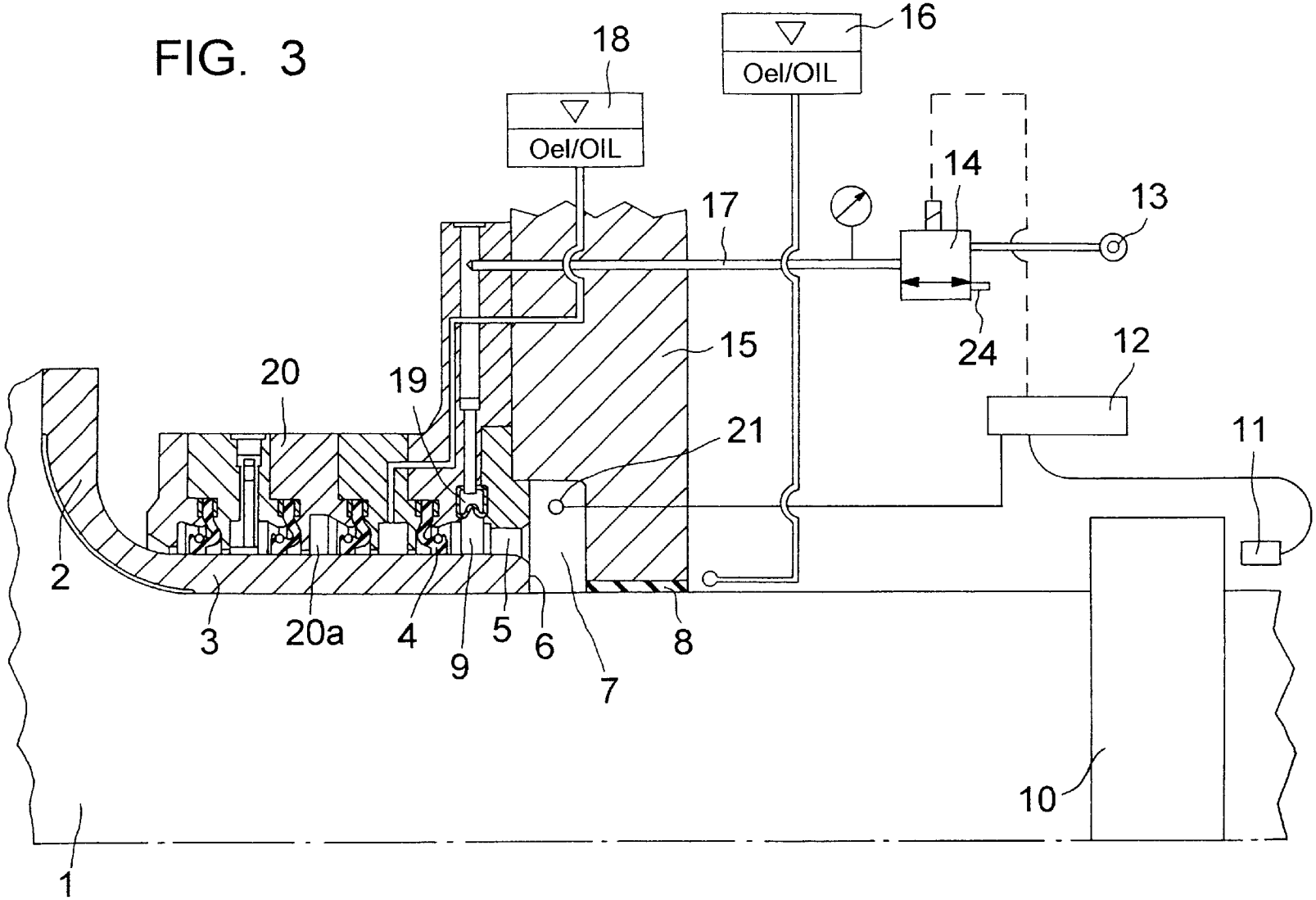
FIG. 3 is a view of a stern tube seal arrangement.

In the illustrated embodiment of FIG. 3, a propeller shaft 1 with a bushing 3 is connected, via a flange 2, with a propeller, not shown, so as to be rotation-fixed and to transmit torque, with the bushing 3 with one end being concluded in the outer water, and with the other end concludes a lubricating oil chamber 7 of a shaft bearing, by way of a annular piston surface 6. At the bushing 3 there are disposed, in spaced apart manner, four annular lip seals 4 as is known.

The lip seals 4 are respectively carried by annular elements 10 (20) which are positioned next to one another, whereby the annular elements adjacent to the lubricating oil chamber 7 are fastened to the stern nut 15.

Oil is supplied for sealing to the region of the lip seals 4 in this case by way of a tank 18, and by way of a tank 16 to the region of the stern tube sleeve or bushing 8. It will be appreciated that bushing 8 may form a bearing for shaft 1 within stern nut 15.

In the embodiment according to FIG. 3, in the adjacent region of the lubricating oil chamber 7 there is made room for an annular chamber 9 between the annular elements 20, which annular chamber 9 comprises an oil channel 5 to the lubricating oil chamber 7, and the chamber 9 comprises an annular tube like expandable body 19; this body 19 can be impacted on one side thereof.

The expandable body 19 is connected, by way of a conduit 17, via a pressure valve 14, with a source of pressure 13, this connection allowing control of the system, and comprises a venting arrangement 24.

In the lubricating oil chamber 7 with associated expandable body 19, there is provided a sensor 21 which senses the arising pressure fluctuations and passes these on to a comparator element 12, and the comparator element 12 correspondingly controls the pressure valve 14, so as to adjust the expandable body 19 in appropriate manner.

The oil pressure fluctuations arising in the lubricating oil chamber 7 and sensed by the sensor 21 are, as a rule, in the form of sinusoidal oscillations. The oil pressure fluctuations, in the form of a sinusoidal or sinus oscillation, are passed, via the comparator element 12, to the pressure valve 14 as actual pressure value conditions. In comparator element 12, however, there is carried out a phase shift of approximately 180 degrees, such that the pressure in the expandable body 19 always respectively achieves a maximum or a minimum when the oil pressure in the lubricating oil chamber 7 respectively attains a minimum or a maximum.

By way of the comparator element 12, the phase position between the axial oscillations of the propeller shaft 1 and the pressure setting in the expandible element 19 is shifted until the measured pressure fluctuations have attained a minimum in the sensor 21.

The expandable body 19 can be impacted with various gases, such as, for example, nitrogen.

Additionally, it is within the scope of the invention to directly measure an actual value of the axial oscillations of the propeller shaft 1 and to pass this value to the comparator 12. For this, the propeller shaft 1 has a clamping ring 10 with an associated oscillation sensor 11.

Figure 4:
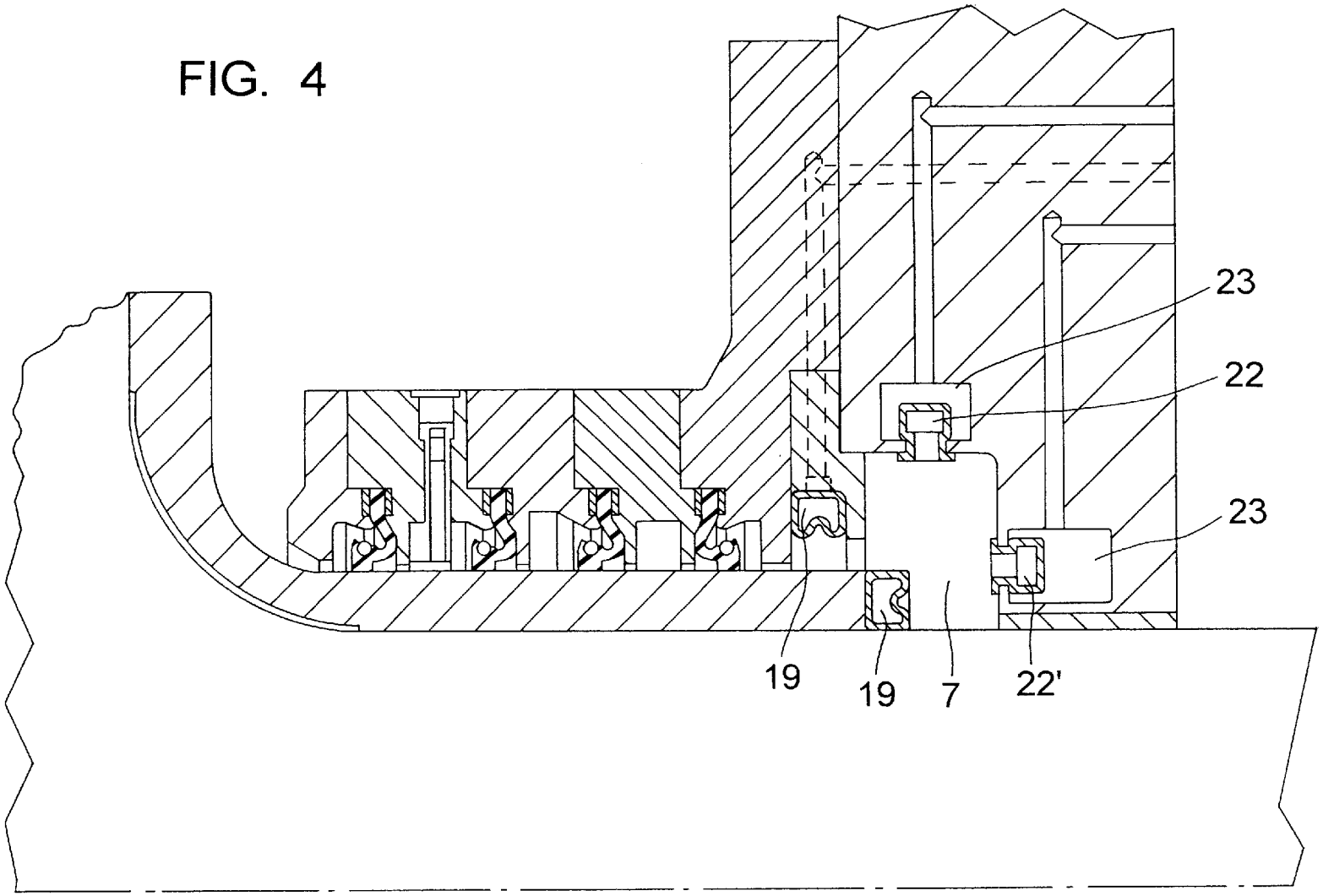
FIG. 4 is a view of a lubricating oil chamber with different configurations of expandable bodies.

According to FIG. 4, various different expandable bodies 19, 19' and 22, 22' are associated with the lubricating oil chamber 7, whereby usually only one expandable body element 19, 22 is associated with lubricating oil chamber 7. The expandable bodies 22, 22' in this case are configured with a receiving space for retention of lubricating oil and with the closed, facing-away sides can be impacted on three sides in a controllable chamber (23) as controllable pressure chamber.

Figure 5:
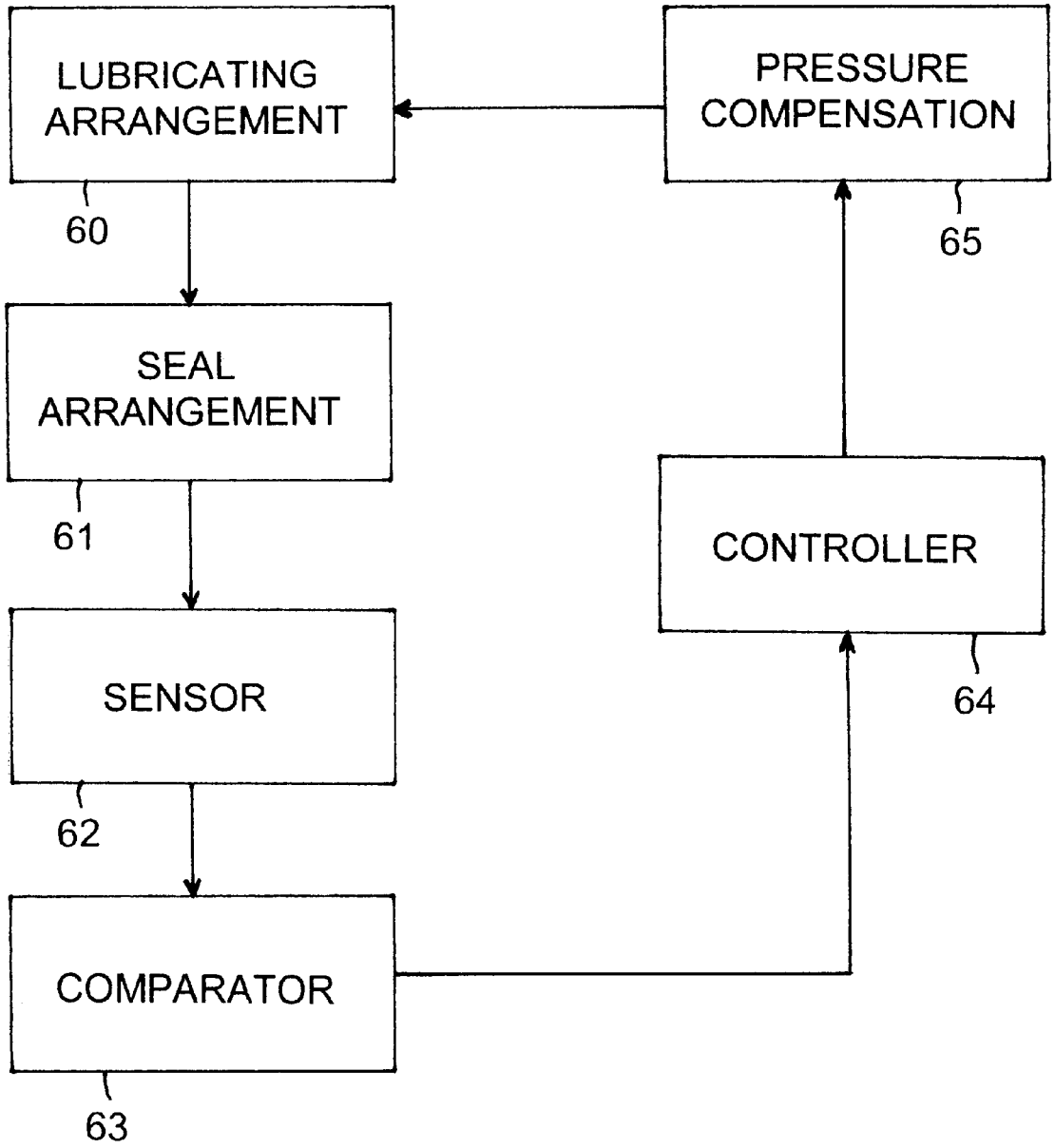
FIG. 5 is a flow diagram of one embodiment of the invention.

FIG. 5 illustrates a flow chart of one embodiment of the invention according to which a lubricating system 60 supplies a seal arrangement 61 with lubricant. The seal arrangement is monitored with a sensor 62 and data from the sensor 62 is passed to the comparator 63. Comparator 63 actuates a controller 64 which, in turn, actuates a pressure compensation arrangement 65 for compensating of pressure fluctuations in the lubricating arrangement 60 and/or seal arrangement 61.

Figure 6:
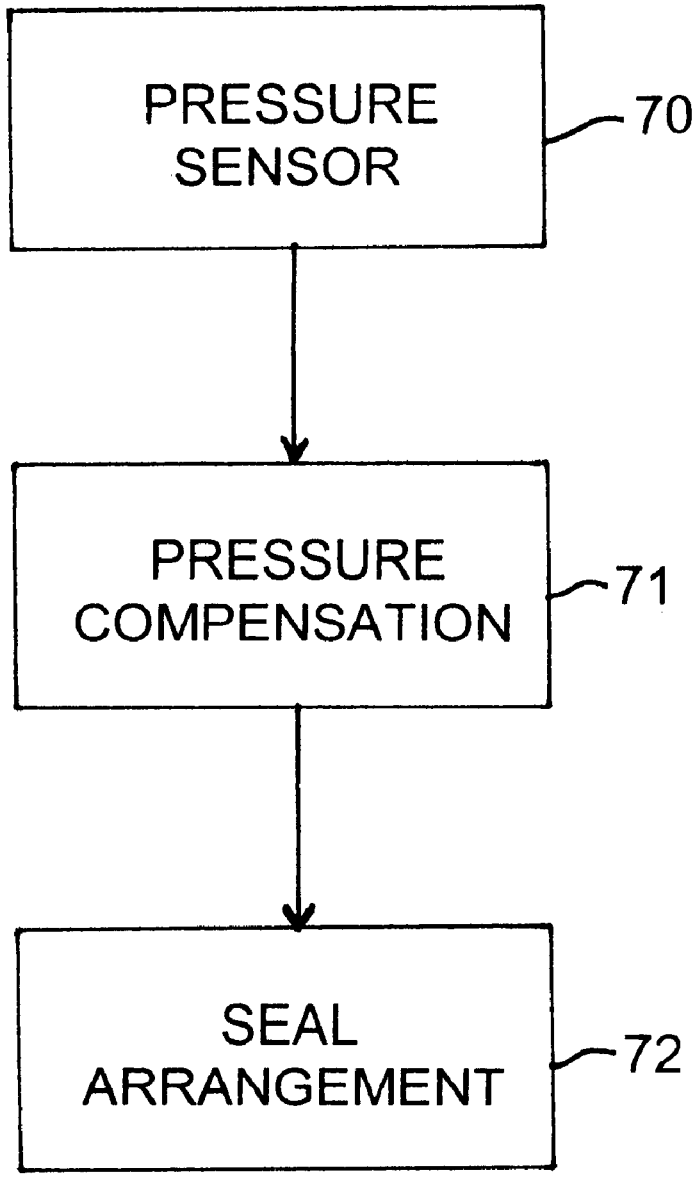
FIG. 6 is a flow diagram of another embodiment of the invention.

FIG. 6 illustrates an embodiment in which a sensor 70 supplies instructions to a pressure compensation arrangement 71 to compensate for pressure fluctuations in a seal arrangement 72.

One feature of the invention resides broadly in a seal arrangement for rotating shafts, particularly for stern tube seals for propeller shafts of ships, which seal arrangement, on the one hand, is near a liquid outer medium and, on the other hand, is near a liquid lubricant for the lubrication of the shaft bearing, and in which seal arrangement seal rings, such as, lip seals are respectively clamped between annular elements and annular chambers are provided between the seal rings for the lubricating medium, as well, a lubricating oil chamber is arranged in front of a seal ring which seal ring is disposed on the side of the bearing for the shaft, at which lubricating oil chamber the bushing of the rotating shaft is concluded characterized thereby that pressure fluctuations that arise in the lubricating oil chamber (7) are passed in the form of axial oscillations of the shaft (1) via an annular piston surface (6) of the bushing (3), by way of a sensor (21), for the determination of pressure changes—as actual value—to a comparator element (12), which comparator element (12) actuates a control element (14), such as, a pressure valve, in order to control the extent of filling of an annular tubular expandable body (19), whereby the expandable body (19) impacts on the lubricating oil chamber (7) and impacts the volume of the lubricating oil chamber (7) with a phase shift of approximately 180 degrees in reference to the sensed pressure impulse, so as to attain a minimized pressure fluctuation in the lubricating oil chamber (7).

Another feature of the invention resides broadly in a seal arrangement characterized thereby that the sensor (21) is disposed in the lubricating oil chamber (7) and/or the axial oscillation of the shaft (1) can be passed by way of a measuring flange (10) with associated measuring sensor (11), for the formulation of an actual value, to the comparator element (12).

Yet another feature of the invention resides broadly in a seal arrangement characterized thereby that the expandable body (19) is disposed in an annular chamber (9) ahead of a seal (4) which is disposed alongside the shaft bearing and ahead of the lubricating oil chamber (7) and the expandable body is connected to the lubricating oil chamber (7) by way of an oil channel (5).

Still another feature of the invention resides broadly in a seal arrangement characterized thereby that the expandable body (19) is configured to be impacted on one side and acts horizontally or vertically upon the lubricating oil chamber (7).

A further feature of the invention resides broadly in a seal arrangement characterized thereby that an expandable body (22) is configured with a receiving space for retention of lubricating oil and with its closed, facing-away side can be impacted on three sides in a controllable chamber (23) as controllable pressure chamber.

Another feature of the invention resides broadly in a seal arrangement according to one of claims 1 to 5 characterized thereby that the comparator element (12) is configured as controller which is supplied with a guide value, and the controller (12) and control element (14) are part of a control circuit.

The features disclosed in the various publications, disclosed or incorporated by reference herein, may be used in the embodiments of the present invention as well as equivalents thereof.

The appended drawings in their entirety, including all dimensions, proportions and/or shapes in at least one embodiment of the invention, are accurate and to scale and are hereby included by reference into this specification.

All, or substantially all, of the components and methods of the various embodiments may be used with at least one embodiment or all of the embodiments, if more than one embodiment is described herein.

All of the patents, patent applications and publications recited herein, and in the Declaration attached hereto, are hereby incorporated by reference as if set forth in their entirety herein.

The corresponding foreign patent application, namely, Federal Republic of Germany Patent Application No. 100 65 587.4 filed on Dec. 28, 2000, entitled, "ABDICHTUNGSVORRICHTUNG FUR ROTIERENDE WELLEN, INSBESONDERE STEVENROHRABDICHTUNG FÜR SCHIFFE," having inventor Ernst-Peter VON BERGEN, and DE-OS 100 65 587 and DE-PS 100 65 587, as well as their published equivalents, and other equivalents or corresponding applications, if any, in corresponding cases in the Federal Republic of Germany and elsewhere, and the references and documents cited in any of the documents cited herein, such as the patents, patent applications and publications, are hereby incorporated by reference as if set forth in their entirety herein.

The following U.S. patent application is hereby incorporated by reference as if set forth in its entirety herein, namely: Ser. No. 09/932,272 filed Aug. 17, 2001, having inventor Ernst-Peter VON BERGEN and entitled "Ocean-going Ship, an Ocean-going Vessel with a Device for Sealing Propeller Drive Shafts, and a Device for Sealing Propeller Drive Shafts in an Ocean-going Vessel" and having Attorney Docket No. NHL-BVA-66 US.

All of the references and documents, cited in any of the documents cited herein, and the references they are in turn cited in are hereby incorporated by reference as if set forth in their entirety herein. All of these references and documents, referred to in the immediately preceding sentence, include all of the patents, patent applications and publications cited anywhere in the present application. All of the references included herein as aforesaid include the corresponding equivalents published by the United States Patent and Trademark Office and elsewhere.

The details in the patents, patent applications and publications may be considered to be incorporable, at applicant's option, into the claims during prosecution as further limitations in the claims to patentably distinguish any amended claims from any applied prior art.

Thus, in one embodiment, the invention relates to a seal arrangement for rotating shafts, particularly for stern tube seals for propeller shafts of ships, which seal arrangement, on the one hand, is near a liquid outer medium and, on the other hand, is near a liquid lubricant for the lubrication of the shaft bearing, and in which seal arrangement seal rings, such as, lip seals, are respectively clamped between annular elements and annular chambers are provided between the seal rings for the lubricating medium, as well, a lubricating oil chamber is arranged in front of a seal ring which seal ring is disposed on the side of the bearing for the shaft, at which lubricating oil chamber the bushing of the rotating shaft is concluded.

It will be appreciated that various devices can possibly be utilized in the pressure fluctuation compensation arrangement. Thus, use can possibly be made of hydraulic, pneumatic and electric devices to compensate for pressure fluctuations in the seal arrangement of a stern tube seal arrangement.

In one embodiment of the invention only one sensor need to be utilized to provide signals representative of lubricating oil pressure oscillations, for a ship's stern tube seal arrangement, due to axial oscillations of the ship's propeller shaft.

Control of lubricating oil pressure oscillations compensation may be effectuated with a computer system for various parameters, such as, draft depth, speed, frequency of oscillations, and so forth.

In one embodiment of the invention only one sensor need to be utilized to provide signals representative of axial oscillations of the ship's propeller shaft. Some examples of systems for measuring the draft depth of a ship and pressure control mechanisms which could possibly be used or adapted for use in at least one possible embodiment of the invention may be found in the following U.S. Pat. No. 5,186,428 to Falkenberg on Feb. 16, 1993, entitled "Depth Gauge Transducer Retractor Device"; U.S. Pat. No. 4,534,217 to Caus on Aug. 13, 1985, entitled "Measuring the Draft of a Vessel"; U.S. Pat. No. 4,622,912 to Bleke on Nov. 18, 1986, entitled "Draft Reduction System for Ships"; U.S. Pat. No. 4,495,880 to Maniscalco et al. on Jan. 29, 1985, entitled "Draft Assisted Delivery System"; U.S. Pat. No. 4,266,500 to Jurca on May 12, 1981, entitled "Hover Control System for a Submersible Buoy"; U.S. Pat. No. 4,995,014 to Hoornstra on Feb. 19, 1991, entitled "Low Frequency Hydrophone and Depth Sensor Assembly"; and U.S. Pat. No. 5,235,557 to Masreliez on Aug. 10, 1993, entitled "Combined Speed and Depth Sensor Transducer". All of the foregoing patents are hereby incorporated by reference as if set forth in their entirety herein.

Some examples of seals for sealing about propeller shafts of ships, including typical lip seals as briefly described above, which may possibly be used or adapted for use in at least one embodiment of the invention may be found in the following U.S. Pat. No. 4,395,141 to Gunter Pietsch et al., issued on Jul. 26, 1983 and entitled "Bearing and Seal Assembly for Stern Tubes of Vessels"; U.S. Pat. No. 4,413,829 to Gunter Pietsch, issued on Nov. 11, 1983 and entitled "Shaft Sealing Assembly"; U.S. Pat. No. 4,413,830 to Gunter Pietsch, issued on Nov. 11, 1983 and entitled "Seal Assembly for Rotating Shafts"; U.S. Pat. No. 4,448,425 to Ernst-Peter Von Bergen, issued on May 15, 1984 and entitled "Shaft Seal Assembly with Inflatable Annular Member"; U.S. Pat. No. 4,696,651 to Wagemann, issued on Sep. 29, 1987 and entitled "Apparatus for a Ship's Propeller"; U.S. Pat. No. 4,984,811 to Kuwabara and Miyazaki on Jan. 15, 1991 entitled "Pressure Control System for Stern Tube Seals"; U.S. Pat. No. 4,984,968 to Laverion on Jan. 15, 1991 entitled "Variable Pitch Propellers"; U.S. Pat. No. 5,137,116 to Ernst-Peter Von Bergen and Gunter Pietsch, issued on Aug. 11, 1992 and entitled "Sealing Device for Rotating Shaft of a Ship Propeller Shaft"; U.S. Pat. No. 5,209,497 issued to Von Bergen, et al. on May 11, 1993 and entitled "Sealing Apparatus for Rotating Shafts, in Particular Stern Tube Seal for the Propeller Shafts of a Ship"; U.S. Pat. No. 5,219,434 issued to Von Bergen, et al. on Jun. 15, 1993 and entitled "Sealing Arrangement for Rotating Propeller Shafts of Ships"; U.S. Pat. No. 5,267,736 issued to Pietsch, et al. on Dec. 7, 1993 and entitled "Sealing Apparatus for Rotating Shafts, in particular Stern Tube Seal for the Propeller Shaft of a Ship"; U.S. Pat. No. 5,308,269 issued to Von Bergen, et al. on May 3, 1994 and entitled "Seal Device for Rotating Shafts, in particular Stern Tube Seal for Propeller Shafts of a Ship"; U.S. Pat. No. 5,356,320 to Von Bergen and Pietsch on Oct. 18, 1994 entitled "Seal Arrangement for Propeller Shafts of Ships"; U.S. Pat. No. 5,411,273 to Pietsch and von Bergen on May 2, 1995, entitled "Lip Seal to Seal a Shaft, In Particular a Ship's Propeller Shaft"; U.S. Pat. No. 5,492,492 issued to Von Bergen, et al. on Feb. 20, 1996 and entitled "Seal Arrangement for Propeller Shafts of Ships"; U.S. Pat. No. 5,624,290 issued to Von Bergen, et al. on Apr. 29, 1997 and entitled "Seal Arrangement for Propeller Shafts of Ships"; U.S. Pat. No. 5,632,661 issued to Jurgens, et al. on May 27, 1997 and entitled "Device, such as a Propeller, for Ships which is Independent of the Main Propeller Propulsion System and can be used as an Active Maneuvering Mechanism"; U.S. Pat. No. 5,643,026 issued to Pietsch, et al. on Jul. 1, 1997 and entitled "Safety Device for Seal Systems for Propeller Shafts on Ships"; U.S. Pat. No. 5,683,278 issued to Pietsch, et al. on Nov. 4, 1997 and entitled "Stern Tube Seal with a Pressure Control System to Adjust to the Changing Draft of Ocean-going Ships"; and U.S. Pat. No. 5,795,199 issued to Langenberg, et al. on Aug. 18, 1998 and entitled "Propeller Drive for Watercraft". All of the foregoing patents are hereby incorporated by reference as if set forth in their entirety herein.

Some examples of oil pressure sensors which may possibly be used or adapted for use in at least one embodiment of the invention may be found in the following U.S. Pat. No. 4,328,480 issued to Keitel, et al. on May 4, 1982 and entitled "System for Monitoring the Lubricating-oil Pressure of an Engine"; U.S. Pat. No. 4,489,311 issued to Lang, et al. on Dec. 18, 1984 and entitled "Engine Oil Pressure Monitor"; U.S. Pat. No. 4,551,069 issued to Gilmore on Nov. 5, 1985 and entitled "Integral Oil Pressure Sensor"; U.S. Pat. No. 4,674,335 issued to Wendt on Jun. 23, 1987 and entitled "Oil Pressure Sensor"; U.S. Pat. No. 4,796,464 issued to Miller on Jan. 10, 1989 and entitled "Electronic Oil Pressure Sensor Device"; U.S. Pat. No. 4,823,117 issued to Burcham on Apr. 18, 1989 and entitled "Electronic Oil Pressure Sensor Circuit"; U.S. Pat. No. 6,113,442 issued to Nakamura on Sep. 5, 2000 and entitled "Indicator Arrangement for Marine Propulsion Engine"; and U.S. Pat. No. 6,243,557 issued to Anthony, et al. on Jun. 5, 2001 and entitled "Offset Preventing Oil Pressure Sensor". All of the foregoing patents are hereby incorporated by reference as if set forth in their entirety herein.

Some examples of vibration sensors which may possibly be used or adapted for use in at least one embodiment of the invention may be found in the following U.S. Pat. No. 4,494,409 issued to Kondo, et al. on Jan. 22, 1985 and entitled "Engine Vibration Sensor"; U.S. Pat. No. 5,323,639 issued to Komurasaki, et al. on Jun. 28, 1994 and entitled "Vibration Sensor"; U.S. Pat. No. 5,798,460 issued to Nakagawa, et al. on Aug. 25, 1998 and entitled "Vibration Sensor Employing a Flexible Diaphragm and an Electret Film"; U.S. Pat. No. 6,053,047 issued to Dister, et al. on Apr. 25, 2000 and entitled "Determining Faults in Multiple Bearings Using One Vibration Sensor"; U.S. Pat. No. 6,109,110 issued to Hwang on Aug. 29, 2000 and entitled "Low Frequency Vibration Sensor"; U.S. Pat. No. 6,135,969 issued to Hale, et al. on Oct. 24, 2000 and entitled "Vibration Sensor"; and U.S. Pat. No. 6,276,213 issued to Lee, Jr., et al. on Aug. 21, 2001 and entitled "Signal Conditioner for a Vibration Sensor". All of the foregoing patents are hereby incorporated by reference as if set forth in their entirety herein.

Some examples of control systems for valves which could possibly be used or adapted for use in at least one embodiment of the invention may be found in the following U.S. Pat. No. 5,218,997 to Dunwoody on Jun. 15, 1993, entitled "Digital Hydraulic Valve Control"; U.S. Pat. No. 5,280,770 to Satou, Takahashi, and Kitagawa on Jan. 25, 1994, entitled "Variable Valve Actuation Control System"; U.S. Pat. No. 4,752,258 to Hochleitner and Gross on Jun. 21, 1988 entitled "Device for Controlling a Cycloid Propeller for Watercraft"; U.S. Pat. No. 5,318,269 to Oettinger and Latt on Jun. 7, 1994, entitled "Electronic Control System for Magnetic Valves Operated Individually or in Cascade"; U.S. Pat. No. 6,155,654 issued to Oyama on Dec. 5, 2000 and entitled "Method of Controlling Electromagnetic Proportional Pressure Control Valve"; U.S. Pat. No. 6,182,658 issued to Hayek on Feb. 6, 2001 and entitled "Fluid Control Valves"; U.S. Pat. No. 6,230,738 issued to Watanabe, et al. on May 15, 2001 and entitled "Flow Rate Control valve and Flow Rate Control System"; and U.S. Pat. No. 6,305,264 issued to Yang, et al. on Oct. 23, 2001 and entitled "Actuator Control Circuit". All of the foregoing patents are hereby incorporated by reference as if set forth in their entirety herein.

Some examples of control systems for ships which could possibly be used or adapted for use in at least one embodiment of the invention may be found in the following U.S. Pat. No. 4,301,759 to de Vries on Nov. 24, 1981 entitled "Control System, Particularly for Use on Ships"; U.S. Pat. U.S. Pat. No. 5,222,901 to Burkenpas on Jun. 29, 1993 entitled "Redundant Marine Engine Control System"; U.S. Pat. No. 5,336,120 to Maurer, Braig, Auer, Goebel, Schwarz and Voss on Aug. 9, 1994, entitled "Control System for Operating a Ship's Motive Installation"; U.S. Pat. No. 5,388,542 to Fischer, Drohula and Luneburg on Feb. 14, 1995 entitled "Water-Borne Ship and Method of Operation Thereof"; U.S. Pat. No. 5,038,269 to Grimble and Fairbairn on Aug. 6, 1991 entitled "Industrial Control Systems"; and U.S. Pat. No. 5,170,338 to Moritoki, Hagiwara, and Katayama on Dec. 8, 1992, entitled "Apparatus for Carrying Out Serial Control and Method of Controlling Said Apparatus". All of the foregoing patents are hereby incorporated by reference as if set forth in their entirety herein.

Some examples of comparator arrangements which may possibly be used or adapted for use in at least one embodiment of the invention may be found in the following U.S. Pat. No. 4,017,843 issued to Yamagishima on Apr. 12, 1977 and entitled "Vehicle Driver Alertness Apparatus Monitoring Steering Wheel Oscillations"; U.S. Pat. No. 4,237,517 issued to Myers on Dec. 2, 1980 and entitled "Motion Monitoring Apparatus"; U.S. Pat. No. 4,317,105 issued to Sinha on Feb. 23, 1982 and entitled "Condition Indicating Device for Wheeled Vehicle Shock Absorbers"; U.S. Pat. No. 6,112,142 issued to Shockley, et al. on Aug. 29, 2000 and entitled "Positive Signal Comparator and Method"; U.S. Pat. No. 6,155,113 issued to Swon, et al. on Dec. 5, 2000 and entitled "Stirring Shaft Monitoring Comparator"; U.S. Pat. No. 6,275,085 issued to Mullarkey on Aug. 14, 2001 and entitled "Comparator for Determining Process Variations"; and U.S. Pat. No. 6,285,206 issued to Higashide on Sep. 4, 2001 and entitled "Comparator Circuit". All of the foregoing patents are hereby incorporated by reference as if set forth in their entirety herein.

Some examples of displacement sensors which may possibly be used or adapted for use in at least one embodiment of the invention may be found in the following U.S. Pat. No. 4,805,633 issued to Kotani on Feb. 21, 1989 and entitled "Displacement Sensor"; U.S. Pat. No. 4,922,198 issued to Sandhagen, et al. on May 1, 1990 and entitled "Displacement Sensor including Piezoelectric Element and a Magnetic Member"; U.S. Pat. No. 5,371,598 issued to Cahalan, et al. on May 31, 1994 and entitled "Optical displacement Sensor and Method for Sensing Linear Displacements in a Shock Absorber"; U.S. Pat. No. 5,450,764 issued to Johnston on Sep. 19, 1995 and entitled "Displacement Sensor"; U.S. Pat. No. 5,717,331 issued to Deller, et al. on Feb. 10, 1998 and entitled "Demodulator Circuit for Use with a Displacement Sensor to Provide Position Information"; U.S. Pat. No. 5,917,600 issued to Rongo, et al. on Jun. 29, 1999 and entitled "Displacement Sensor"; and U.S. Pat. No. 6,311,572 issued to Gier on Nov. 6, 2001 and entitled "Displacement Sensor". All of the foregoing patents are hereby incorporated by reference as if set forth in their entirety herein.

Some examples of transducers which may possibly be used or adapted for use in at least one embodiment of the invention may be found in the following U.S. Pat. No. 6,105,437 issued to Klug, et al. Aug. 22, 2000 and entitled "Pressure Transducer"; U.S. Pat. No. 6,272,928 issued to Kurtz on Aug. 14, 2001 and entitled "Hermetically Sealed Absolute and Differential Pressure Transducer"; U.S. Pat. No. 6,286,372 issued to Von Rauch on Sep. 11, 2001 and entitled "Pressure Differential Measuring Transducer"; U.S. Pat. No. 6,301,969 issued to Hess on Oct. 16, 2001 and entitled "Pressure Transducer Assembly on a Process Circuit of a Process Plant"; and U.S. Pat. No. 6,330,829 issued to Kurtz, et al. on Dec. 18, 2001 and entitled "Oil-filled Pressure Transducer". All of the foregoing patents are hereby incorporated by reference as if set forth in their entirety herein.

Some examples of controllers and control circuits which may possibly be used or adapted for use in at least one embodiment of the invention may be found in the following U.S. Pat. No. 4,090,121 issued to Nelson, et al. on May 16, 1978 and entitled "Control Circuit"; U.S. Pat. No. 4,415,966 issued to Herzog on Nov. 15, 1983 and entitled "Control Circuit for a Controller and a Method of Operating the Same"; U.S. Pat. No. 4,447,869 issued to Herzog on May 8, 1984 and entitled "Control Circuit with an Auxiliary Process Variable"; U.S. Pat. No. 4,509,110 issued to Levesque, Jr., et al. on Apr. 2, 1985 and entitled "Method and Apparatus for Detecting Failures in a Control System"; U.S. Pat. No. 4,698,574 issued to Yoshizawa, et al. on Oct. 6, 1987 and entitled "Process Control Apparatus"; U.S. Pat. No. 4,874,994 issued to Eisenberg on Oct. 17, 1989 and entitled "Control Circuit for a Controller for Use with a Controlled Element"; U.S. Pat. No. 5,182,500 issued to Shimada on Jan. 26, 1993 and entitled "Brushless Motor Control Circuit"; U.S. Pat. No. 5,189,349 issued to Haga on Feb. 23, 1993 and entitled "Drive Circuit for Multi-phase Brushless DC Motor Including Drive Current Detector"; U.S. Pat. No. 5,194,787 issued to Antognini on Mar. 16, 1993 and entitled "Control Circuit for an Electric Motor without a Collector"; U.S. Pat. No. 5,204,606 issued to Kuwahara, et al. on Apr. 20, 1993 and entitled "Induction Motor Control Apparatus"; U.S. Pat. No. 5,504,672 issued to Hardiman, et al. on Apr. 2, 1996 and entitled "Industrial Process Controller and Method of Process Control"; U.S. Pat. No. 5,775,236 issued to Fenn, et al. on Jul. 7, 1998 and entitled "Combustion Control Circuit of Combustion Apparatus"; U.S. Pat. No. 5,910,784 issued to Lai on Jun. 8, 1999 and entitled "Control Circuit of a Remote Controller"; U.S. Pat. No. 6,020,709 issued to Sasaki on Feb. 1, 2000 and entitled "Automatic Controller"; U.S. Pat. No. 6,152,542 issued to Sasaki on Nov. 28, 2000 and entitled "Automatic Controller"; U.S. Pat. No. 6,246,331 issued to McHugh, et al. on Jun. 12, 2001 and entitled "Apparatus for Sensing Fluid Flow and Associated Load Control Circuit"; and U.S. Pat. No. 6,246,333 issued to Doner, et al. on Jun. 12, 2001 and entitled "Apparatus for Sensing Fluid Flow and Associated Load Control Circuit". All of the foregoing patents are hereby incorporated by reference as if set forth in their entirety herein.

Some examples of feedforward systems, features of which may possibly be used or adapted for use in at least one embodiment of the invention may be found in the following U.S. Pat. No. 5,555,267 issued to Burke, Jr., et al. on Sep. 10, 1996 and entitled "Feedforward Control System, Method and Control Module"; U.S. Pat. No. 5,561,599 issued to Lu on Oct. 1, 1996 and entitled "Method of Incorporating Independent Feedforward Control in a Multivariable Predictive Controller"; U.S. Pat. No. 5,654,619 issued to Iwashita on Aug. 5, 1997 and entitled "Method of Feedforward Control for Servomotor"; U.S. Pat. No. 5,703,504 issued to Chun, et al. on Dec. 30, 1997 and entitled "Feedforward Adaptive Threshold Processing Method"; U.S. Pat. No. 6,095,426 issued to Ahmed on Aug. 1, 2000 and entitled "Room Temperature Control Apparatus Having Feedforward and Feedback Control and Method"; U.S. Pat. No. 6,114,670 issued to Erickson, et al. on Sep. 5, 2000 and entitled "Nonlinear Feedforward Control for Ramp Following and Overshoot Minimization"; and U.S. Pat. No. 6,240,330 issued to Kurtzberg, et al. on May 29, 2001 and entitled "Method for Feedforward Corrections for Off-specification Conditions". All of the foregoing patents are hereby incorporated by reference as if set forth in their entirety herein.

Some examples of feedback systems, features of which may possibly be used or adapted for use in at least one embodiment of the invention may be found in the following U.S. Pat. No. 4,516,894 issued to Stolpp on May 14, 1985 and entitled "Load Pressure Feedback System Having at Least One Control Valve for controlling an Apparatus"; U.S. Pat. No. 4,733,152 issued to Allington on Mar. 23, 1988 and entitled "Feedback System"; U.S. Pat. No. 4,883,091 issued to Weiler, et al. on Nov. 28, 1989 and entitled "Multi-port Self-regulating Proportional Pressure Control Valve"; U.S. Pat. No. 4,893,526 issued to Tokoro on Jan. 16, 1990 and entitled "Continuous Variable Transmission Control System"; U.S. Pat. No. 5,154,207 issued to Bolt on Oct. 13, 1992 and entitled "Pressure Control Valve and Transducer Package"; U.S. Pat. No. 5,620,524 issued to Fan, et al. on Apr. 15, 1997 and entitled "Apparatus for Fluid Delivery in Chemical Vapor Deposition System"; and U.S. Pat. No. 6,161,571 issued to Taylor on Dec. 19, 2000 and entitled "Modulating Relief valve". All of the foregoing patents are hereby incorporated by reference as if set forth in their entirety herein.

Some examples of high frequency servomotors, features of which may possibly be used or adapted for use in at least one embodiment of the invention may be found in the following U.S. Pat. No. 4,215,723 issued to Ichiryu, et al. on Aug. 5, 1980 and entitled "Fluid pressure Servo Valve Assembly"; and U.S. Pat. No. 4,881,211 issued to Myers on Nov. 14, 1989 and entitled "Multiple Frequency range Hydraulic Actuator". All of the foregoing patents are hereby incorporated by reference as if set forth in their entirety herein.

Some examples of active suspension systems with transducers, features of which may possibly be used or adapted for use in at least one embodiment of the invention may be found in the following U.S. Pat. No. 5,110,152 issued to Jones on May 5, 1992 and entitled "Active Suspension System"; U.S. Pat. No. 5,137,299 issued to Jones on Aug. 11, 1992 and entitled "Active Suspension System"; U.S. Pat. No. 5,232,242 issued to Bachrach, et al. on Aug. 3, 1993 and entitled "Power Consumption Limiting Means for an Active Suspension System"; U.S. Pat. No. 5,299,488 issued to Kadlicko, et al. on Aug. 5, 1994 and entitled "Active Suspension System"; U.S. Pat. No. 5,519,612 issued to Liubakka, et al. on May 21, 1996 and entitled "Active Suspension System with Adaptive Actuator Gain Adjustment"; and U.S. Pat. No. 5,522,221 issued to Kadlicko, et al. on Jun. 4, 1996 and entitled "Active Suspension System". All of the foregoing patents are hereby incorporated by reference as if set forth in their entirety herein.

Some examples of utilization of nitrogen in seal arrangements, features of which may possibly be used or adapted for use in at least one embodiment of the invention may be found in the following U.S. Pat. No. 5,529,315 issued to Borrino, et al. on Jun. 25, 1996 and entitled "Tandem Seal Arrangement for Mechanical Face Seals"; U.S. Pat. No. 5,700,546 issued to Fuji, et al. on Dec. 23, 1997 and entitled "Seal or Bearing"; U.S. Pat. No. 5,756,429 issued to Ichihashi on May 26, 1998 and entitled "Lubricating Oil Composition for High-speed Gear"; U.S. Pat. No. 5,924,697 issued to Parker, et al. on Jul. 20, 1999 and entitled "Double Gas Seal with Bellows Supported by Backing and Support Rings"; U.S. Pat. No. 5,941,531 issued to Parker, et al. on Aug. 24, 1999 and entitled "Double Gas Seal Having an Improved Bellows"; and U.S. Pat. No. 6,325,378 issued to Okumachi, et al. on Dec. 4, 2001 and entitled "Shaft Seal Apparatus". All of the foregoing patents are hereby incorporated by reference as if set forth in their entirety herein.

Some examples of artificial intelligence systems and methods, features of which may possibly be used or adapted for use in at least one embodiment of the invention may be found in the following U.S. Pat. No. 4,967,337 issued to English, et al. on Oct. 30, 1990 and entitled "Automated Diagnostic System"; U.S. Pat. No. 5,309,485 issued to Chao on May 3, 1994 and entitled "Core Automated Monitoring System"; U.S. Pat. No. 5,319,572 issued to Wilhelm, et al. on Jun. 7, 1994 and entitled "Electrohydraulic Fluid Monitor System"; U.S. Pat. No. 5,392,320 issued to Chao on Feb. 21, 1995 and entitled "Core Automated Monitoring System"; U.S. Pat. No. 6,308,649 issued to Gedeon, et al. on Oct. 30, 2001 and entitled "Sailboat and Crew Performance Optimization System"; U.S. Pat. No. 6,311,136 issued to Henry, et al. on Oct. 30, 2001 and entitled "Digital Flowmeter"; U.S. Pat. No. 6,324,665 issued to Fay on Nov. 27, 2001 and entitled "Event Based Fault Diagnosis"; U.S. Pat. No. 6,325,378 issued to Okumachi, et al. on Dec. 4, 2001 and entitled "Shaft Seal Apparatus"; U.S. Pat. No. 6,330,525 issued to Hays, et al. on Dec. 11, 2001 and entitled "Method and Apparatus for Diagnosing a Pump System"; and U.S. Pat. No. 6,331,964 issued to Barone on Dec. 18, 2001 and entitled "Motion Detectors and Occupancy Sensors based In Displacement Detection". All of the foregoing patents are hereby incorporated by reference as if set forth in their entirety herein.

Some examples of expandible bodies, features of which may possibly be used or adapted for use in at least one embodiment of the invention may be found in the following U.S. Pat. No. 5,209,497 issued to Von Bergen, et al. on May 11, 1993 and entitled "Sealing Apparatus for Rotating Shafts, in Particular Stern Tube Seal for the Propeller Shafts of a Ship"; U.S. Pat. No. 3,963,394 issued to Garver, et al. on Jul. 6, 1982 and entitled "Bladder for Shaping Pneumatic Tires"; U.S. Pat. No. 4,173,988 issued to Fowler on Nov. 13, 1979 and entitled "Pneumatically Actuated Thread Protector for Pipes"; U.S. Pat. No. 4,338,051 issued to Garver, et al. on Jul. 6, 1982 and entitled "Profile Cutting Machine"; U.S. Pat. No. 4,945,745 issued to Bathony, et al. on Aug. 7, 1990 and entitled "Telescopic Drive Spindle Assembly"; U.S. Pat. No. 5,318,539 issued to O'Neil on Jun. 7, 1994 and entitled "Liquid Feeding Apparatus Utilizing Capillary Tubing, and Syringe Driver"; and U.S. Pat. No. 5,447,672 issued to O'Neil on Sep. 5, 1995 and entitled "Manufacture of Capillary Tubing". All of the foregoing patents are hereby incorporated by reference as if set forth in their entirety herein.

Some examples of pressure switches which could possible be used or adapted for use in at least one possible embodiment of the invention may be found in the following U.S. Pat. No. 4,150,268 to Stearley, Rowley, and Buckshaw on Apr. 17, 1979, entitled "Pressure Operated Switch Construction Having a One-piece Control Shaft Bracket Structure"; U.S. Pat. No. 4,158,117 to Quilliam, Gallantree, and Watt, on Jun. 12, 1979, entitled "Pressure Sensitive Switch"; U.S. Pat. No. 4,160,139 to Johnston, on Jul. 3, 1979, entitled "Pressure Sensitive Switch"; U.S. Pat. No. 4,165,650 to Weissler, on Aug. 28, 1979, entitled "Dual Purpose Pressure Sensor"; U.S. Pat. No. 4,168,415 to Edwards, Penland, Warren, Roberts, on Sep. 18, 1979, entitled "Pressure Switch Having Modular Construction"; and U.S. Pat. No. 4,182,941 to Tashiro on Jan. 8, 1980, entitled "Improved Pressure Switch". All of the foregoing patents are hereby incorporated by reference as if set forth in their entirety herein.

Some examples of control valves which could possibly be used or adapted for use in at least one possible embodiment of the invention may be found in the following U.S. Pat. No. 4,142,549 to Autry on Mar. 6, 1979, entitled "Relief Valve"; U.S. Pat. No. 4,168,723 to Schneider on Sep. 25, 1979, entitled "Pressure Relief Valve"; U.S. Pat. No. 4,178,940 to Au on Dec. 18, 1979, entitled "Pressure Control Systems"; U.S. Pat. No. 4,185,652 to Zintz, Fisher, and Gee on Jan. 29, 1980 entitled "Subaqueous Sequence Valve Mechanism"; U.S. Pat. No. 4,401,347 issued to Kawaguchi, et al. on Aug. 30, 1983 and entitled "Fluid Pressure Control Valve for Dual Braking System"; U.S. Pat. No. 4,947,893 issued to Miller, et al. on Aug. 14, 1990 and entitled "Variable Force Solenoid Pressure Regulator for Electronic Transmission Controller"; U.S. Pat. No. 5,439,085 issued to Woessner on Aug. 8, 1995 and entitled "Oscillation Damper"; U.S. Pat. No. 5,775,360 issued to Hayashi, et al. on Jul. 7, 1998 and entitled "Pressure Control Valve"; U.S. Pat. No. 5,775,370 issued to Kaneko, et al. on Jul. 7, 1998 and entitled "Fluid Pressure Control Valve Apparatus"; U.S. Pat. No. 5,927,323 issued to Kikuchi, et al. on Jul. 27, 1999 and entitled "Pressure Control Valve"; U.S. Pat. No. 6,244,253 issued to Haeberer, et al. on Jun. 12, 2001 and entitled "Pressure Control Valve"; U.S. Pat. No. 6,269,827 issued to Potter on Aug. 7, 2001 and entitled "Electrically Operated Pressure Control Valve"; and U.S. Pat. No. 6,289,927 issued to Kaneko on Sep. 18, 2001 and entitled "Pressure Control valve". All of the foregoing patents are hereby incorporated by reference as if set forth in their entirety herein.

Some examples of solenoid valves which could possibly be used or adapted for use in at least one possible embodiment of the invention may be found in the following U.S. Pat. No. 4,177,774 to Moshal on Dec. 11, 1979, entitled "Control Valves"; U.S. Pat. No. 4,180,241 to Fiedler on Dec. 25, 1979, entitled "Solenoid Operated Valve and Shut-Off Device"; and U.S. Pat. No. 4,195,667 to Moore and Price on Apr. 1, 1980 entitled "Solenoid Valve with Safety Control Circuit". All of the foregoing patents are hereby incorporated by reference as if set forth in their entirety herein.

One feature of the invention resides broadly in an ocean-going ship, said ship comprising:

a propeller;

a shaft (1) mounted for rotation of said propeller;

bearing means (8) to journal said shaft (1);

a bushing (3) mounted on said shaft (1);

said bushing (3) having a first end immersed in water when said ship is afloat on water, and a second end (6) opposite said first end near said bearing means (8);

a plurality of seals (4) mounted on said bushing (3);

said plurality of seals (4) comprising lip seals;

a plurality of annular elements (20) to maintain said plurality of seals (4) in spaced apart relationship on said bushing (3);

said plurality of annular elements (20) being configured and disposed to provide a plurality of first annular chambers **(20*a*) for lubricant to lubricate at least said bearing means (8)**;

said bushing (3) comprising an annular surface (6) at said second end thereof;

said annular surface (6) at said second end of said bushing (3) being configured and disposed to form a portion of a second annular chamber (7) for lubricant to lubricate said bearing means (8);

said plurality of seals (4) being configured and disposed to minimize ingress of water and to retain lubricant for said bearing means (8) in sais second annular chamber (7);

at least one seal of said plurality of seals (4) being configured and disposed adjacent to said bearing means (8);

a sensor (21);

said sensor (21) being configured and disposed to sense at least one parameter representative of pressure variations of a lubricant in said second annular chamber (7) due to axial oscillations of said shaft (1);

said sensor being further configured to produce a signal representative of pressure variations of a lubricant in said second annular chamber (7) due to axial oscillations of said shaft (1);

a comparator element (12);

said comparator element (12) being configured and disposed to receive signals representative of pressure variations of a lubricant in said second annular chamber (7) due to axial oscillations of said shaft (1);

said comparator element (12) further being configured to compare signals representative of pressure variations of a lubricant in said second annular chamber (7) due to axial oscillations of said shaft (1) with desired pressure conditions;

a control element (14);

said control element (14) being configured and disposed to receive signals from said comparator element (12) to effectuate compensation for pressure variations of a lubricant in said second annular chamber (7) due to axial oscillations of said propeller shaft (1);

an expandable and contractable element (19);

said expandable and contractable element (19) being configured to be filled with a pressure medium and to exert pressure on a lubricant in said second annular chamber (7) to compensate for pressure variations of a lubricant in said second annular chamber (7) due to axial oscillations of said propeller shaft (1);

said comparator (12) being further configured to pass signals, to said control element (14), to effectuate compensation for pressure variations of a lubricant in said second annular chamber (7) due to axial oscillations of said propeller shaft (1); and said control element (14) being configured to control the extent of filling of said expandable and contractable element (19) to thus adjust pressure conditions exerted upon a lubricant in said second annular chamber (7) with a phase shift of approximately 180 degrees for an actual lubrication pressure condition in said second annular chamber (7);

thus forming an arrangement to compensate and to minimize lubrication pressure fluctuations, of a ship's stern tube seal arrangement (4), due to axial oscillations of said propeller shaft (1).

Another feature of the invention resides broadly in the ship comprising:

a third annular chamber (9) disposed between said second annular chamber and an adjacent first annular chamber **(20*a*); and an oil channel (5) connecting said third annular chamber (9) and said adjacent first annular chamber (20*a*)** wherein:

said expandable and contractable element (19) is disposed in said third annular chamber (9) and configured to exert pressure upon said second annular chamber (7) by transmission of pressure upon oil in said third annular chamber (9), said oil channel (5) and said second annular chamber (7);

to thus minimize loss of oil from a ship's stern tube seal arrangement and to minimize failure or degeneration of the performance of a ship's stern tube seal arrangement.

Yet another feature of the invention resides in the ship wherein:

said expandable and contractable element (19) comprises a volumetric transducer being configured to change its volume and generate a pressure to compensate for and to minimize stern tube seal lubrication pressure oscillations due to axial oscillations of said propeller shaft (1).

Still another feature of the invention resides broadly in a ship an arrangement to compensate lubrication pressure fluctuations in a ship's stern tube seal arrangement due to axial oscillations of a ship's propeller shaft, said arrangement comprising:

a shaft (1) mounted for rotation of a ship's propeller;

bearing means (8) to journal said shaft (1);

a bushing (3) mounted on said shaft (1);

said bushing (3) having a first end immersed in water when the ship is afloat on water, and a second end (6) opposite said first end and adjacent to said bearing means (8);

a seal arrangement (4) configured and disposed to minimize ingress of water and to retain lubricant for said bearing means(8);

a lubricating arrangement (18, 16) configured and disposed to provide lubricant to said seal arrangement (4) and to said bearing means (8);

a sensor (21);

said sensor (21) being configured and disposed to sense at least one parameter representative of pressure variations in said seal arrangement (4) due to axial oscillations of said propeller shaft (1);

said sensor (21) further being configured to generate signals representative of pressure variations in said seal arrangement (4);

a comparator element (12);

said comparator element (12) being configured and disposed to receive signals, representative of pressure variations in said seal arrangement (4), from said sensor (21);

said comparator element (12) further being configured to compare signals representative of pressure variations in said seal arrangement (4) with desired pressure conditions;

a control element (14) configured and disposed to receive signals from said comparator element (12) to effectuate compensation for pressure variations in said seal arrangement (4) due to axial oscillations of said propeller shaft (1); and an expandable and contractable element (19);

said expandable and contractable element (19) being configured to be filled with a pressure medium and to exert pressure on a lubricant in said lubricating arrangement to compensate for pressure variations in said seal arrangement (4) due to axial oscillations of said propeller shaft (1);

said comparator (12) being further configured to pass signals, to said control element (14), to effectuate compensation for pressure variations in said seal arrangement (4) due to axial oscillations of said propeller shaft (1); and said control element (14) being configured to control the extent of filling of said expandable and contractable element (19) to thus adjust pressure conditions exerted in said lubricating arrangement with a phase shift of approximately 180 degrees for the sensed lubrication pressure in said lubricating arrangement;

thus forming an arrangement to compensate and to minimize lubrication pressure fluctuations, of a ship's stern tube seal arrangement (4), due to axial oscillations of said propeller shaft (1).

A further feature of the invention resides broadly in a compensation arrangement wherein:

said expandable and contractable body (19) is configured to be impacted on at least one side; and said expandable and contractable body (19) is disposed to impact said second annular chamber (7) from above or from a side thereof.

Another feature of the invention resides broadly in the compensation arrangement wherein:

said expandable and contractable body (19) comprises a hollow body configured to be filled with a fluid comprising one of: oil, liquid, and gas;

to thus minimize loss of oil from a ship's stern tube seal arrangement and to minimize failure or degeneration of the performance of a ship's stern tube seal arrangement.

Yet another feature of the invention resides broadly in the compensation arrangement wherein:

said expandable and contractable body (19) comprises a first expandable and contractable body (19);

said ship comprising:

at least one pressure control chamber (23) connected to a source of pressure;

at least one second expandable and contractable body (22) disposed in said at least one pressure control chamber;

said at least one second expandable and contractable body (22) comprising a hollow body configured with three outer sides and configured to be filled with lubricating oil;

said at least one second expandable and contractable body (22) further being configured to be filled with lubricating oil to minimize pressure fluctuations in said second annular chamber (7).

Still another feature of the invention resides broadly in the compensation arrangement wherein:

said at least one pressure control chamber (23) is connected to a source of pressure to pressurize said at least one second expandable and contractable body (22).

A further feature of the invention resides broadly in the compensation arrangement comprising:

a control circuit;

said control circuit connecting at least said sensor (21), said comparator element (12), and said control element (14);

wherein said comparator comprises controller configured to receive at least one guide value to control pressure fluctuations in said second annular chamber (7).

Another feature of the invention resides broadly in the compensation arrangement wherein:

said control element comprises a pressure control valve (14).

Yet another feature of the invention resides broadly in the compensation arrangement wherein:

said sensor (21) is disposed in said second annular chamber (7).

Still another feature of the invention resides broadly in the compensation arrangement comprising:

a measuring flange (10) connected to said shaft (1); and said sensor (1) being configured and disposed to sense oscillations of said measuring flange (10);

said sensor (11) further being configured to provide at least one signal representative of axial oscillations of said shaft (1) to said comparator element (12).

A further feature of the invention resides broadly in an arrangement to compensate lubrication pressure oscillations in a ship's stern tube seal arrangement due to axial oscillations of a ship's propeller shaft, said compensating arrangement comprising:

a sensor (21) configured to be disposed to sense at least one parameter representative of pressure oscillations, in a ships's stern tube seal arrangement, due to axial oscillations of a ship's propeller shaft (1); and an arrangement (65, 71) configured to be disposed to compensate for oscillations of lubrication pressure due to axial oscillations of a ship's propeller shaft to compensate for and to minimize stern tube seal lubrication pressure oscillations of a ship's stern tube seal arrangement due to axial oscillations of a ship's propeller shaft;

said compensation arrangement (65, 71) being configured to receive a signal from said sensor, to thus form an arrangement to compensate for and to minimize lubrication pressure oscillations in a ship's stern tube seal arrangement due to axial oscillations of a ship's propeller shaft.

Another feature of the invention resides broadly in the arrangement wherein:

said sensor (11) is configured to generate and transmit at least one signal representative of axial oscillations of a ship's propeller shaft (1) to said compensation arrangement.

Yet another feature of the invention resides broadly in the arrangement wherein:

said sensor (11) is configured to generate and transmit at least one signal representative of lubricating oil pressure oscillations of a ship's tube seal arrangement to said compensation arrangement.

Still another feature of the invention resides broadly in the arrangement wherein:

said sensor (11) comprises a sensor configured to generate and transmit either (a.) or (b.), and (a.) and (b.), where (a.) is: at least one signal representative of axial oscillations of a ship's propeller shaft (1) to said compensation arrangement; where (b.) is: at least one signal representative of lubricating oil pressure oscillations of a ship's tube seal arrangement to said compensation arrangement;

to thus minimize loss of oil from a ship's stern tube seal arrangement and to minimize failure or degeneration of the performance of a ship's stern tube seal arrangement.

A further feature of the invention resides broadly in the arrangement wherein:

said compensation arrangement comprises apparatus configured to generate pressure oscillations substantially 180 degrees opposite to the lubrication pressure oscillations due to axial oscillations of a ship's propeller shaft.

Another feature of the invention resides broadly in the arrangement wherein:

said compensation arrangement comprises a volumetric transducer being configured to change its volume and generate a pressure to compensate for and to minimize stern tube seal lubrication pressure oscillations due to axial oscillations of a ship's propeller shaft.

Yet another feature of the invention resides broadly in the arrangement wherein:

said volumetric transducer comprises an expandable and contractable bladder.

Still another feature of the invention resides broadly in the arrangement comprising:

an arrangement to provide a fluid to expand and contract said bladder; to thus minimize loss of oil from a ship's stern tube seal arrangement and to minimize failure or degeneration of the performance of a ship's stern tube seal arrangement.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clauses are intended to cover the structures described herein as performing the recited function and not only structural equivalents but also equivalent structures.

This invention as described hereinabove in the context of the preferred embodiments is not to be taken as limited to all of the provided details thereof, since modifications and variations thereof may be made without departing from the spirit and scope of the invention.

What is claimed is:

1. An ocean-going ship, said ship comprising:

a propeller;

a shaft mounted for rotation of said propeller;

bearing means to journal said shaft;

a bushing mounted on said shaft;

said bushing having a first end immersed in water when said ship is afloat on water, and a second end opposite said first end near said bearing means;

a plurality of seals mounted on said bushing;

said plurality of seals comprising lip seals;

a plurality of annular elements to maintain said plurality of seals in spaced apart relationship on said bushing;

said plurality of annular elements being configured and disposed to provide a plurality of first annular chambers for lubricant to lubricate at least said bearing means;

said bushing comprising an annular surface at said second end thereof;

said annular surface at said second end of said bushing being configured and disposed to form a portion of a second annular chamber for lubricant to lubricate said bearing means;

said plurality of seals being configured and disposed to minimize ingress of water and to retain lubricant for said bearing means in said second annular chamber;

at least one seal of said plurality of seals being configured and disposed adjacent to said bearing means; a sensor;

said sensor being configured and disposed to sense at least one parameter representative of pressure variations of a lubricant in said second annular chamber due to axial oscillations of said shaft;

said sensor being further configured to produce a signal representative of pressure variations of a lubricant in said second annular chamber due to axial oscillations of said shaft;

a comparator element;

said comparator element being configured and disposed to receive signals representative of pressure variations of a lubricant in said second annular chamber due to axial oscillations of said shaft;

said comparator element further being configured to compare signals representative of pressure variations of a lubricant in said second annular chamber due to axial oscillations of said shaft with desired pressure conditions;

a control element;

said control element being configured and disposed to receive signals from said comparator element to effectuate compensation for pressure variations of a lubricant in said second annular chamber due to axial oscillations of said propeller shaft;

an expandable and contractable element;

said expandable and contractable element being configured to be filled with a pressure medium and to exert pressure on a lubricant in said second annular chamber to compensate for pressure variations of a lubricant in said second annular chamber due to axial oscillations of said propeller shaft;

said comparator being further configured to pass signals, to said control element, to effectuate compensation for pressure variations of a lubricant in said second annular chamber due to axial oscillations of said propeller shaft; and said control element being configured to control the extent of filling of said expandable and contractable element to thus adjust pressure conditions exerted upon a lubricant in said second annular chamber with a phase shift of approximately 180 degrees for an actual lubrication pressure condition in said second annular chamber;

thus forming an arrangement to compensate and to minimize lubrication pressure fluctuations, of a ship's stern tube seal arrangement, due to axial oscillations of said propeller shaft.

2. The ship according to claim 1, comprising:

a third annular chamber disposed between said second annular chamber and an adjacent first annular chamber; and an oil channel connecting said third annular chamber and said adjacent first annular chamber wherein:

said expandable and contractable element is disposed in said third annular chamber and configured to exert pressure upon said second annular chamber by transmission of pressure upon oil in said third annular chamber, said oil channel and said second annular chamber;

to thus minimize loss of oil from a ship's stern tube seal arrangement and to minimize failure or degeneration of the performance of a ship's stern tube seal arrangement.

3. The ship according to claim 2, wherein:

said expandable and contractable element comprises a volumetric transducer being configured to change its volume and generate a pressure to compensate for and to minimize stern tube seal lubrication pressure oscillations due to axial oscillations of said propeller shaft.

4. In a ship an arrangement to compensate lubrication pressure fluctuations in a ship's stern tube seal arrangement due to axial oscillations of a ship's propeller shaft, said arrangement comprising:

a shaft mounted for rotation of a ship's propeller;

bearing means to journal said shaft;

a bushing mounted on said shaft;

said bushing having a first end immersed in water when the ship is afloat on water, and a second end opposite said first end and adjacent to said bearing means;

a seal arrangement configured and disposed to minimize ingress of water and to retain lubricant for said bearing means; a lubricating arrangement configured and disposed to provide lubricant to said seal arrangement and to said bearing means; a sensor;

said sensor being configured and disposed to sense at least one parameter representative of pressure variations in said seal arrangement due to axial oscillations of said propeller shaft;

said sensor further being configured to generate signals representative of pressure variations in said seal arrangement;

a comparator element;

said comparator element being configured and disposed to receive signals, representative of pressure variations in said seal arrangement, from said sensor;

said comparator element further being configured to compare signals representative of pressure variations in said seal arrangement with desired pressure conditions;

a control element configured and disposed to receive signals from said comparator element to effectuate compensation for pressure variations in said seal arrangement due to axial oscillations of said propeller shaft; and an expandable and contractable element;

said expandable and contractable element being configured to be filled with a pressure medium and to exert pressure on a lubricant in said lubricating arrangement to compensate for pressure variations in said seal arrangement due to axial oscillations of said propeller shaft;

said comparator being further configured to pass signals, to said control element, to effectuate compensation for pressure variations in said seal arrangement due to axial oscillations of said propeller shaft; and said control element being configured to control the extent of filling of said expandable and contractable element to thus adjust pressure conditions exerted in said lubricating arrangement with a phase shift of approximately 180 degrees for the sensed lubrication pressure in said lubricating arrangement;

thus forming an arrangement to compensate and to minimize lubrication pressure fluctuations, of a ship's stern tube seal arrangement, due to axial oscillations of said propeller shaft.

5. The compensation arrangement according to claim 4, wherein:

said expandable and contractable body is configured to be impacted on at least one side; and said expandable and contractable body is disposed to impact said second annular chamber from above or from a side thereof.

6. The compensation arrangement according to claim 5, wherein:

said expandable and contractable body comprises a hollow body configured to be filled with a fluid comprising one of: oil, liquid, and gas;

to thus minimize loss of oil from a ship's stern tube seal arrangement and to minimize failure or degeneration of the performance of a ship's stern tube seal arrangement.

7. The compensation arrangement according to claim 6, wherein:

said expandable and contractable body comprises a first expandable and contractable body;

said ship comprising:

at least one pressure control chamber connected to a source of pressure;

at least one second expandable and contractable body disposed in said at least one pressure control chamber;

said at least one second expandable and contractable body comprising a hollow body configured with three outer sides and configured to be filled with lubricating oil;

said at least one second expandable and contractable body further being configured to be filled with lubricating oil to minimize pressure fluctuations in said second annular chamber.

8. The compensation arrangement according to claim 7, wherein:

said at least one pressure control chamber is connected to a source of pressure to pressurize said at least one second expandable and contractable body.

9. The compensation arrangement according to claim 8, comprising:

a control circuit;

said control circuit connecting at least said sensor, said comparator element, and said control element;

wherein said comparator comprises controller configured to receive at least one guide value to control pressure fluctuations in said second annular chamber.

10. The compensation arrangement according to claim 9, wherein:

said control element comprises a pressure control valve.

11. The compensation arrangement according to claim 10, wherein:

said sensor is disposed in said second annular chamber.

12. The compensation arrangement according to claim 11, comprising:

a measuring flange connected to said shaft; and said sensor being configured and disposed to sense oscillations of said measuring flange;

said sensor further being configured to provide at least one signal representative of axial oscillations of said shaft to said comparator element.

13. An arrangement to compensate lubrication pressure oscillations in a ship's stern tube seal arrangement due to axial oscillations of a ship's propeller shaft, said compensating arrangement comprising:

a sensor configured to be disposed to sense at least one parameter representative of pressure oscillations, in a ships's stern tube seal arrangement, due to axial oscillations of a ship's propeller shaft; and an arrangement configured to be disposed to compensate for oscillations of lubrication pressure due to axial oscillations of a ship's propeller shaft to compensate for and to minimize stern tube seal lubrication pressure oscillations of a ship's stern tube seal arrangement due to axial oscillations of a ship's propeller shaft;

said compensation arrangement being configured to receive a signal from said sensor, to thus form an arrangement to compensate for and to minimize lubrication pressure oscillations in a ship's stern tube seal arrangement due to axial oscillations of a ship's propeller shaft.

14. The arrangement according to claim 13, wherein:

said sensor is configured to generate and transmit at least one signal representative of axial oscillations of a ship's propeller shaft to said compensation arrangement.

15. The arrangement according to claim 13, wherein:

said sensor is configured to generate and transmit at least one signal representative of lubricating oil pressure oscillations of a ship's tube seal arrangement to said compensation arrangement.

16. The arrangement according to claim 13, wherein:

said sensor comprises a sensor configured to generate and transmit either (a.) or (b.), and (a.) and (b.), where (a.) is:

at least one signal representative of axial oscillations of a ship's propeller shaft to said compensation arrangement; where (b.) is: at least one signal representative of lubricating oil pressure oscillations of a ship's tube seal arrangement to said compensation arrangement;

to thus minimize loss of oil from a ship's stern tube seal arrangement and to minimize failure or degeneration of the performance of a ship's stern tube seal arrangement.

17. The arrangement according to claim 16, wherein:

said compensation arrangement comprises apparatus configured to generate pressure oscillations substantially 180 degrees opposite to the lubrication pressure oscillations due to axial oscillations of a ship's propeller shaft.

18. The arrangement according to claim 17, wherein:

said compensation arrangement comprises a volumetric transducer being configured to change its volume and generate a pressure to compensate for and to minimize stern tube seal lubrication pressure oscillations due to axial oscillations of a ship's propeller shaft.

19. The arrangement according to claim 18, wherein: said volumetric transducer comprises an expandable and contractable bladder.

20. The arrangement according to claim 19, comprising:

an arrangement to provide a fluid to expand and contract said bladder;

to thus minimize loss of oil from a ship's stern tube seal arrangement and to minimize failure or degeneration of the performance of a ship's stern tube seal arrangement.

* * * * *